US011843189B2

(12) United States Patent
Pueschner et al.

(10) Patent No.: US 11,843,189 B2
(45) Date of Patent: Dec. 12, 2023

(54) METHOD AND DEVICE FOR TRIMMING AN ANTENNA APPLIED ON A CARRIER, METHOD FOR PRODUCING A CARRIER STRUCTURE, CARRIER STRUCTURE AND CHIP CARD

(71) Applicant: Infineon Technologies AG, Neubiberg (DE)

(72) Inventors: Frank Pueschner, Kelheim (DE); Jens Pohl, Bernhardswald (DE)

(73) Assignee: Infineon Technologies AG, Neubiberg (DE)

( * ) Notice: Subject to any disclaimer, the term of this patent is extended or adjusted under 35 U.S.C. 154(b) by 433 days.

(21) Appl. No.: 16/507,422

(22) Filed: Jul. 10, 2019

(65) Prior Publication Data

US 2020/0028263 A1 Jan. 23, 2020

(30) Foreign Application Priority Data

Jul. 18, 2018 (DE) ..... 102018117364.4

(51) Int. Cl.
*H01Q 11/12* (2006.01)
*H01Q 7/00* (2006.01)
*H01Q 1/22* (2006.01)

(52) U.S. Cl.
CPC ..... *H01Q 7/00* (2013.01); *H01Q 1/2283* (2013.01)

(58) Field of Classification Search
CPC ..... H01Q 7/00; H01Q 1/2283; H01Q 1/2225; H01Q 1/38; H01Q 1/2216
See application file for complete search history.

(56) References Cited

U.S. PATENT DOCUMENTS 4,900,386 A * 2/1990 Richter-Jorgensen ..... G08B 13/2442 257/E27.114
4,970,495 A * 11/1990 Matsumoto ..... G08B 13/2442 340/572.1
5,081,445 A * 1/1992 Gill ..... G08B 13/2437 340/572.1
5,288,235 A * 2/1994 Sobhani ..... H01R 12/61 174/254
5,351,872 A * 10/1994 Kobayashi ..... B23K 20/02 228/6.2

(Continued)

FOREIGN PATENT DOCUMENTS

CN 1119768 A 4/1996
CN 1315027 A 9/2001

(Continued)

OTHER PUBLICATIONS

Office Action dated Sep. 14, 2020 issued for chinese Patent Application No. 201910644405.1.

(Continued)

*Primary Examiner* — Hai V Tran
*Assistant Examiner* — Bamidele A Immanuel
(74) *Attorney, Agent, or Firm* — Banner & Witcoff Ltd.

(57) ABSTRACT

A method for trimming an antenna applied on a carrier, the method including pressing a region of the carrier out from a carrier plane of the carrier, the region having a portion of the antenna and the region being selected according to a target property of the antenna, and removing at least a part of the portion of the antenna from the pressed-out region of the carrier.

23 Claims, 12 Drawing Sheets

(56) References Cited

U.S. PATENT DOCUMENTS 5,430,441 A * 7/1995 Bickley ..... G06K 7/10059 340/10.2
5,528,222 A * 6/1996 Moskowitz ..... G06K 19/07786 29/829
5,566,441 A * 10/1996 Marsh ..... B65D 5/4233 257/E21.511
6,018,299 A * 1/2000 Eberhardt ..... B65D 5/4233 361/748
6,233,818 B1 * 5/2001 Finn ..... G06K 19/077 235/382
6,451,154 B1 * 9/2002 Grabau ..... G06K 17/0025 257/679
8,677,592 B2 * 3/2014 In't Veld ..... C03B 33/027 29/426.4
2001/0011413 A1 * 8/2001 Yamaguchi ..... H01L 24/78 29/600
2001/0054230 A1 * 12/2001 Finn ..... G06K 19/07749 29/748
2002/0135522 A1 * 9/2002 Yamamoto ..... H01Q 1/007 343/702
2002/0152604 A1 * 10/2002 Debraal ..... H05K 3/046 29/846
2002/0160786 A1 * 10/2002 Rietzler ..... H01Q 9/27 340/572.1
2003/0116635 A1 * 6/2003 Taban ..... G06K 19/07783 235/492
2004/0117985 A1 * 6/2004 Chung ..... H05K 3/222 29/840
2005/0085010 A1 * 4/2005 Tsunoda ..... G06K 19/07722 438/106
2006/0043199 A1 * 3/2006 Baba ..... G06K 19/07758 235/492
2007/0193021 A1 * 8/2007 Kobayashi ..... G06K 19/07752 29/601
2008/0198078 A1 * 8/2008 Caruana ..... H01Q 1/2208 343/745
2008/0283615 A1 * 11/2008 Finn ..... G06K 19/07769 235/488
2010/0141453 A1 * 6/2010 Finn ..... G06K 19/07749 340/572.7
2010/0147958 A1 * 6/2010 Martinent ..... G06K 19/027 235/492
2011/0260924 A1 * 10/2011 Roy ..... H01Q 1/38 343/700 MS
2011/0275318 A1 * 11/2011 Sato ..... H01Q 1/2208 455/41.1
2012/0080527 A1 * 4/2012 Finn ..... G06K 19/07745 235/492
2014/0059841 A1 * 3/2014 Finn ..... H01Q 1/40 29/601
2014/0060722 A1 * 3/2014 Finn ..... B42D 15/00 156/73.1
2014/0084070 A1 * 3/2014 Pueschner ..... G06K 7/10178 235/492
2014/0091149 A1 * 4/2014 Finn ..... G06K 19/07794 235/492
2014/0104132 A1 * 4/2014 Bakalski ..... H01L 23/66 333/32
2014/0196278 A1 * 7/2014 Finn ..... H01Q 1/38 29/600
2014/0268607 A1 * 9/2014 Wicker ..... H05K 3/321 361/761
2014/0284386 A1 * 9/2014 Finn ..... H01Q 7/06 235/488
2014/0306260 A1 * 10/2014 Yamazaki ..... H04M 1/0266 257/99
2015/0021402 A1 * 1/2015 Finn ..... H01Q 1/2216 235/492
2015/0028547 A1 * 1/2015 Haglund ..... F16J 15/08 277/312
2015/0070238 A1 * 3/2015 de Rochemont .. H01Q 15/0086 343/843
2015/0097040 A1 * 4/2015 Rampetzreiter ..... G06K 19/07794 235/492
2015/0097741 A1 * 4/2015 Pachler ..... H01Q 7/00 343/742
2015/0178615 A1 * 6/2015 Finn ..... G06K 19/07794 235/492
2015/0180130 A1 * 6/2015 Yang ..... B23K 26/351 343/700 MS
2015/0235122 A1 * 8/2015 Finn ..... H05K 1/0233 235/439
2015/0269477 A1 * 9/2015 Finn ..... H01Q 1/38 235/492
2015/0278675 A1 * 10/2015 Finn ..... G06K 19/07747 235/492
2015/0356399 A1 * 12/2015 Finn ..... H01Q 1/2283 29/600
2016/0118711 A1 * 4/2016 Finn ..... H01Q 1/2283 343/867
2016/0351514 A1 * 12/2016 Ikeda ..... H01L 24/17
2017/0206448 A1 * 7/2017 Pueschner ..... G06K 19/07794
2018/0037006 A1 * 2/2018 Droste ..... B32B 17/10293
2018/0175484 A1 * 6/2018 Tsai ..... H01Q 5/35

FOREIGN PATENT DOCUMENTS

CN 101006457 A 7/2007
CN 104321566 A 1/2015
CN 104636788 A 5/2015
CN 106997482 A 8/2017
DE 102016100898 A1 7/2017

OTHER PUBLICATIONS

German Patent Office, Office Action issued for DE 102018117364.4, 5 pgs., dated Mar. 11, 2019.
Office Action dated Mar. 6, 2021 issued for Chinese Patent Application No. 20191064445.1.

* cited by examiner

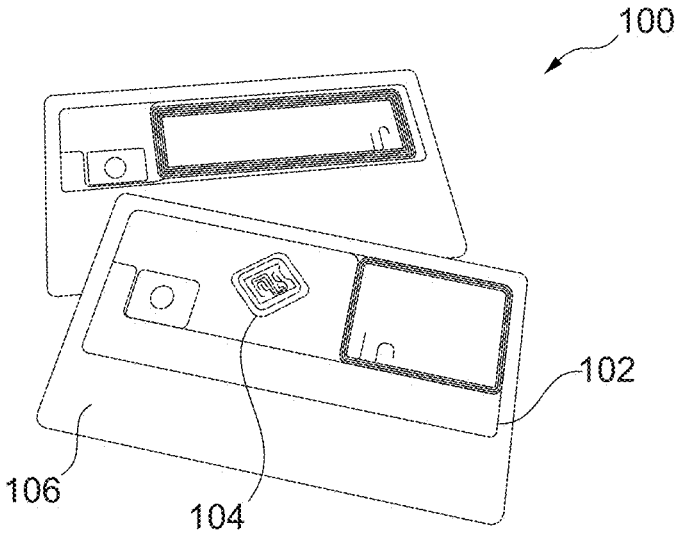
Fig. 1A
FIG. 1B
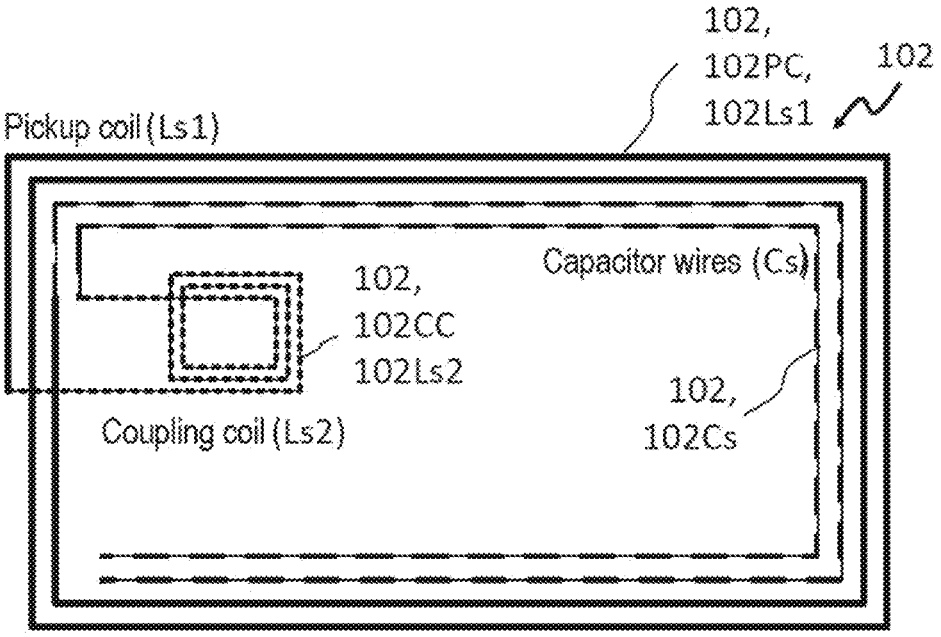

METHOD AND DEVICE FOR TRIMMING AN ANTENNA APPLIED ON A CARRIER, METHOD FOR PRODUCING A CARRIER STRUCTURE, CARRIER STRUCTURE AND CHIP CARD

The disclosure relates to a method and a device for trimming an antenna applied on a carrier, to a method for producing a carrier structure, to a carrier structure having a carrier on which an antenna is applied (also referred to as an antenna structure for brevity), and to a chip card.

A booster antenna, which may for example be part of a chip card for wireless communication with an external reader (for example a chip card 100 as is represented in FIG. 1A), as is represented in FIG. 1B and FIG. 1C, may comprise a series tuned circuit that comprises an inductor 102PC, 102Ls1, an (ohmic) resistance (which is for example provided by means of a resistance of the conductive line that forms the antenna), and a capacitor 102Cs.

The antenna may be formed by using several technologies, for example printing, etching, etc. Recently, experience has shown that a wire embedding technology represents one of the most economical and most efficient ways of producing booster antennas. In this technology, a via, solder pad or other type of connection is usually not required. As is represented in FIG. 1B, the wire is simply arranged as a coil and a series capacitor. If necessary, the wire may be arranged in such a way that it comprises meander structures, which may be used in order to produce a series resistor.

The principle of a conventional series tuned-circuit booster antenna is schematically illustrated in FIG. 1C. As can be seen with the aid of FIG. 1C, the booster antenna 102 may comprise a pickup coil inductor 102Ls1 for coupling (with a coupling factor k1, which may also be referred to as a coupling coefficient k1) to an external reader 108, a coupling coil inductor 102Ls2 for coupling to a module antenna 110 which is applied on a chip module 104 that carries a chip, a resistor 102Rs (which is produced by the wire, for example a copper wire) and a series capacitor 102Cs.

These electrical components may, for example, be formed and arranged by means of a wire embedding method as represented in FIG. 1B.

As an embedding device, it is possible to use an ultrasonic wire feed tool (also referred to as a sonotrode), which may comprise a wire delivery channel (also referred to as a capillary) that extends through the middle of the wire feed tool. The wire conductor may be fed through the wire feed tool and emerge from the tip of the wire feed tool, and may be "rubbed" into a substrate material during a movement of the wire feed tool, by applying pressure and ultrasound vibrations. This is the case because spatially limited heating of the substrate material may be induced by the pressure and vibrations, which can lead to lowering of the wire conductor into the substrate.

However, precision of the embedding device (for example the sonotrode) is limited, which may lead to large production tolerances. During the production of a booster antenna inlay, the production tolerances of a conventional wire embedding device may lead to a variation range of the resonant frequency of the antenna inlay being about 1 MHz around an intended target resonant frequency.

During production of embedded-wire booster antennas for so-called coil-on-module (CoM) chip cards, which can provide contactless interaction on the one hand between the booster antenna and an external reader and on the other hand between the booster antenna and a chip module antenna, the production tolerance of the wire embedding method of about 1 MHz and the resulting degradation of the performance of the coil-on-module chip cards are currently tolerated.

In order to be able to implement high-power coil-on-module products, a variation range of the resonant frequencies of the booster antennas should be as small as possible. Currently, an increase in the accuracy of the wire embedding method is possible only by reducing a speed of the embedding method, but this increases the production costs.

In various exemplary embodiments, a method is provided which makes it possible to reprocess an already produced antenna according to a target property. The target property may, for example, be a target resonant frequency.

This means that after its production, for example after installation, an antenna may be modified, for example tuned, by means of an additional process with a view to a target property. In this way, the target resonant frequency may be achieved or at least the variation range may be reduced.

For example, a maximum deviation from the target resonant frequency may be restricted by the trimming to at most 200 kHz, for example at most 150 kHz.

In this case, the reprocessing is carried out in such a way that a portion of the antenna is removed by means of a simple and economical process without thereby removing a carrier, on which the antenna is located, at the reprocessed position. Rather, in various exemplary embodiments a part of the carrier is pressed out from the carrier plane in order to permit removal of the antenna part. Subsequently, the pressed-out part of the carrier may be pressed back into the carrier plane (for example during lamination).

The reprocessing may, in various exemplary embodiments, be carried out in a capacitive region of the antenna.

In order to permit the removal of a portion of the antenna, the pressed-out region of the carrier with the antenna arranged thereon may be separated, for example cut through or sheared transversely (for example obliquely, perpendicularly or approximately perpendicularly) to the antenna direction at two points (also referred to as separating points, and corresponding positions for the formation of the separating points as separating positions). The portion of the antenna may, in various exemplary embodiments, consist of a single part, i.e. for example of a single piece of the antenna line. In various exemplary embodiments, the portion of the antenna may comprise a plurality of parts, for example two or four. This may, for example, be the case when two capacitive antenna lines are arranged next to one another.

The separation of the carrier and of the antenna may be carried out simultaneously with the pressing out or before the pressing out. In this case, a carrier region lying between the two carrier points may remain connected to the rest of the carrier at two points.

The pressing of the region of the carrier (also referred to as a carrier region) from the carrier plane may be carried out by a force acting perpendicularly to the carrier plane being exerted on the carrier region. The pressing out may be continued until the carrier region is deformed (i.e. stretched) beyond its elastic limit, so that the carrier region also remains pressed out from the carrier plane after the end of the action of the force on the carrier, that is to say it has been plastically deformed. The pressing out may, in various exemplary embodiments, be continued until the carrier region between the antenna and the die breaks.

In other words, after the deformation, the carrier region lying between the separating points may be located at least partially outside the plane of the carrier. The carrier region lying between the separating points may still be connected to, and merge into, the rest of the carrier where the separating points end (these regions are also referred to as connecting regions), while the carrier region lying between the separating points may have been pressed furthest out from the carrier plane approximately in its middle.

The deformation (for example stretching) may lead to the antenna portion (also referred to as a portion (of the antenna)), detached from the rest of the antenna, arranged on or in this carrier region being released from the carrier region and exposed, and consequently being easily removable from the carrier region.

The removal of the portion of the antenna may, for example, be carried out by an outer side of the carrier region facing downward, so that the antenna portion can fall out simply under the effect of gravity, or for example by using compressed air or by means of reduced pressure.

In order to permit removal of the antenna portion after the pressing out of the region of the carrier, it may be necessary that the carrier on at least one surface (which then forms an outer side of the pressed-out region) does not fully cover the antenna at least in the pressed-out region. In other words, at least the portion to be removed should already be exposed before the pressing out of the carrier region, even in a case in which an entire antenna cross section is embedded in the carrier.

Embedding of the entire antenna cross section may be advantageous to the extent that, before the trimming, the antenna is therefore already embedded in the carrier, a dielectric, substantially fully (except for the part exposed on the surface of the carrier). Accordingly, measurements relating to the target properties the antenna, for example of its resonant frequency, may already substantially yield the same values as are achieved after full lamination. This would possibly not be the case if the antenna before the trimming was only partially embedded in the carrier, and partially in for example air. In order to achieve the full embedding, a so-called prepress process may for example be carried out after the installation of the antenna.

Typically, even in a case in which the capacitive part of the antenna is arranged on the region of the carrier as two antenna lines extending parallel, i.e. the portion of the antenna comprises two parts, it may be sufficient for only one of the two parts to be removed. In various exemplary embodiments, however, a plurality of, for example all, parts of the portion may be removed from the carrier region.

After the removal of the portion (or of a part thereof), the carrier, which may for example be formed as a so-called antenna inlay, may be ready for further processing, for example lamination into a chip card.

In various exemplary embodiments, the carrier region may be restored into the plane of the carrier, for example by means of a mechanical process, for example pushing or pressing, after the removal of the portion (or of the part of the antenna portion) and before further processing or simultaneously with further processing. This process may, in various exemplary embodiments, be carried out with the assistance of heat and/or ultrasound. The carrier may therefore be restored into its flat shape without projections and/or recesses.

For the method for trimming the antenna applied on the carrier, a device may be used which comprises a reception region for receiving the carrier. In this case, the reception region may comprise a recess. The device may furthermore comprise a die which is adapted to press a region of the carrier out from the carrier plane into the recess. In this case, the carrier region may be selected in such a way that the target property of the antenna (for example its resonant frequency) is achieved or at least approached.

The device may comprise at least one cutting edge for separating the antenna.

In a case in which the device comprises only one cutting edge, after the first cutting process (in order to form a first of the separating points) this may be brought into another position in order to carry out a second cutting process that in order to form a second of the separating points.

In a case in which the device comprises two (for example parallel) cutting edges, the antenna (and with it the carrier) may be separated simultaneously on two sides.

In various exemplary embodiments, the pressing of the carrier region out from the carrier plate may be carried out simultaneously with the separation of the antenna.

For simultaneous pressing out of the carrier region and separation of the antenna, a device may be used which comprises a die and two cutting plates spaced apart by the recess. Simultaneous pressing out of the carrier region and separation of the antenna may also be referred to as a separating-pressing process.

The die may be formed convexly (or more precisely convexly only in a direction along the gap between the cutting plates), in which case the precise shape, for example the precise curvature, may depend on the material which is intended to be pressed out, or cut. The die may for example be formed on its surface as a cylinder segment, or for example as two cylinder segments connected by a flat region.

During the pressing out of the part of the carrier, in the case of depression of the die onto the part of the carrier with the antenna in such a way that the die presses the carrier with the antenna into the gap between the two cutting plates, the die cuts (or shears) the carrier material and the antenna arranged thereon or therein between the die and the two cutting plates, i.e. for example along two parallel cutting or shearing edges. At the same time with the separation, deformation of the carrier region pressed between the two cutting plates may be carried out. After the deformation, the carrier region may remain pressed out from the carrier plane and, for example, have the same contour (for example curvature) as the die.

In various exemplary embodiments, the device may be configured in such a way that the cutting plates may be omitted. The pressing out and the separation may, for example, be carried out as two separate processes, for example by initially arranging cuts by means of the at least one cutting edge, for example by means of a blade, which is successively guided to the two separating positions, or by means of two blades. The carrier region between the cuts may then be pressed out by means of the die, similarly as described above, except with no shearing taking place along the cutting plates. The cutting and/or the deformation may, if this is advantageous for the process, be carried out on a resilient, for example elastic, base.

In various exemplary embodiments, the die may be formed in such a way that the cutting and the pressing out can be carried out successively in one working step, for example by cutting edges, for example blades, for separating the antenna (and the carrier) being arranged along the side edges of the above-described die. During further depression of the die onto the carrier, the carrier region may be deformed between the separating points, as described above.

Although the pressing-separating process described here for trimming the antenna (also referred to as tuning the antenna) may in principle be carried out at any point in the capacitive region of the antenna, the antenna may be formed in such a way that, when arranging the antenna, it is configured in such a way that tuning points are formed in the capacitive region of the antenna, which are configured in such a way that they assist the pressing-separating process, for example by their being far enough away from antenna lines that are not intended to be separated.

For example, the capacitive region of the antenna may be formed in such a way that separation of precisely two neighboring antenna lines at one or more positions along the capacitive region is made possible. The capacitive region may in this case be formed with a repeating structure, in such a way that the intended positions have regular spacings that correspond to predetermined differences between the corresponding resonant frequencies, for example differences of 100 kHz, 150 kHz or 200 kHz. The capacitive region may, in various exemplary embodiments, be formed in such a way that a positioning tolerance of the separating regions is increased.

In various exemplary embodiments, the booster antenna may be configured in such a way that it comprises a predetermined region that is intended for the trimming.

Furthermore, in various exemplary embodiments, a measuring unit may be provided which is capable of determining the resonant frequency of the antenna.

Because the carrier region from which the part of the antenna is removed is not itself removed from the carrier, it is possible to ensure that, despite the interruption of the antenna, the carrier is not structurally weakened and/or a surface of a chip card formed by means of the carrier structure with an applied antenna has a smooth (i.e. not uneven) surface.

Exemplary embodiments of the disclosure are represented in the figures and will be explained in more detail below.

FIG. 1A shows a photograph of two partially disassembled conventional chip cards, which respectively comprise a booster antenna and a chip module (CoM);

FIG. 1B shows a schematic plan view of a conventional booster antenna;

Figure 2A:
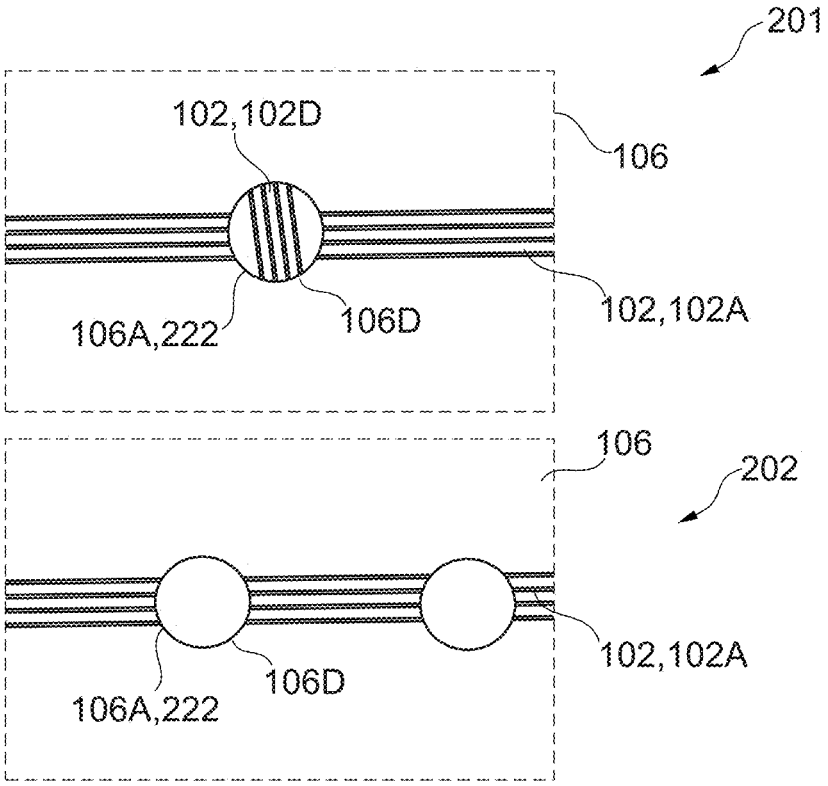
FIG. 2A shows two detailed photographic views, which respectively show a carrier in which a part of the carrier is stamped out with a part of the antenna and the stamped-out part of the carrier is arranged rotated, in a through-opening formed in the carrier by the stamping out, in such a way that the antenna remains electrically interrupted.
Figure 2B:
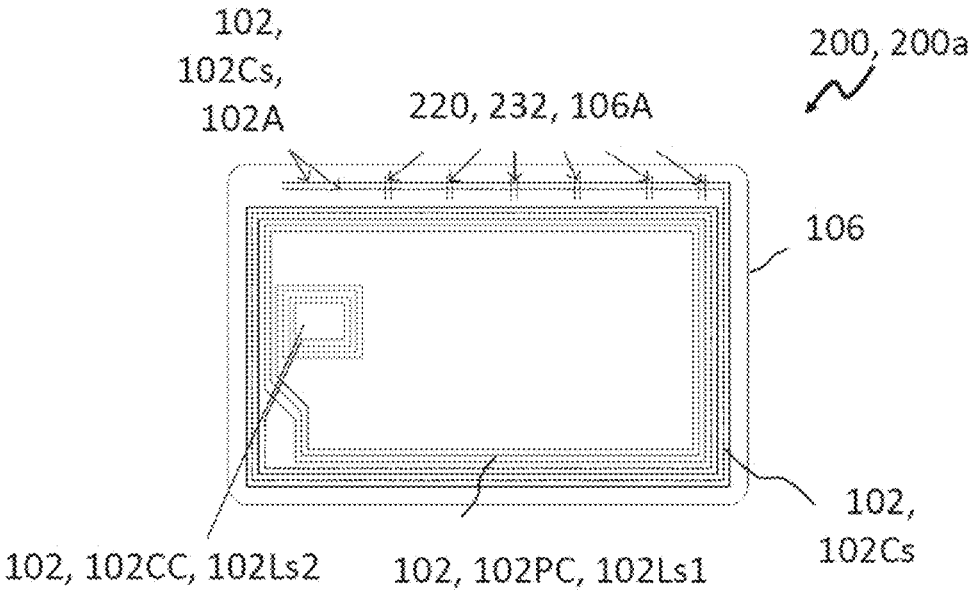
Figure 2C:
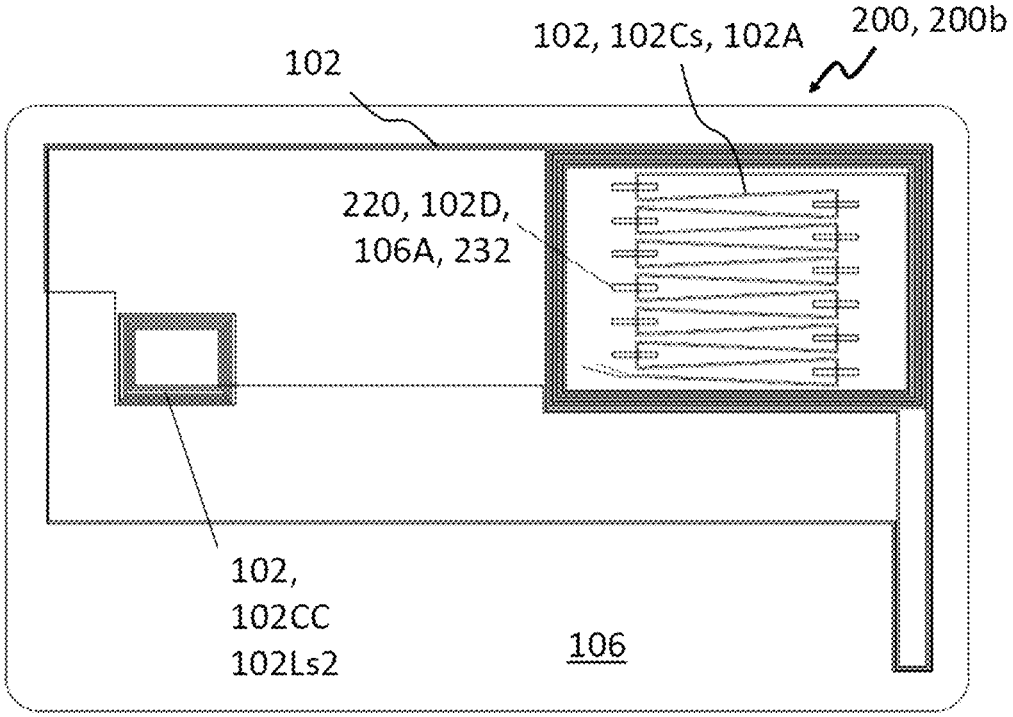
Figure 2D:
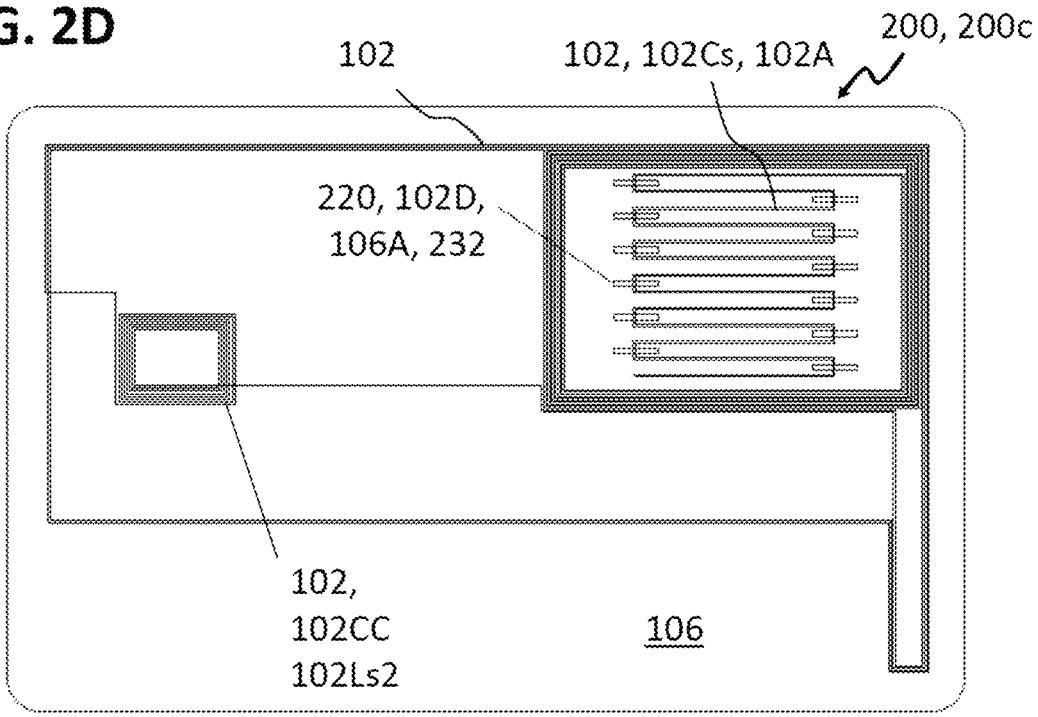
Figure 3:
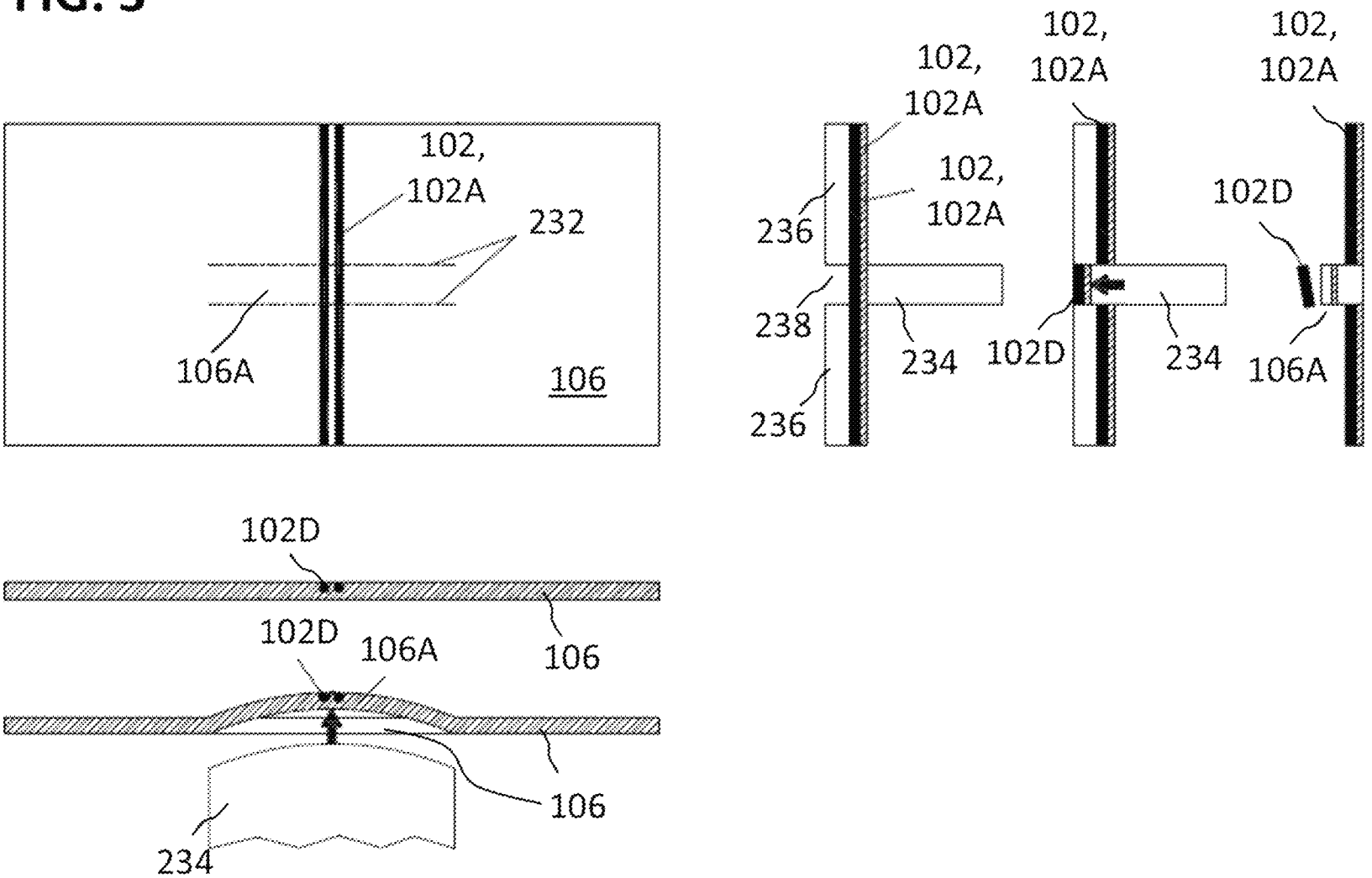
Figure 5:
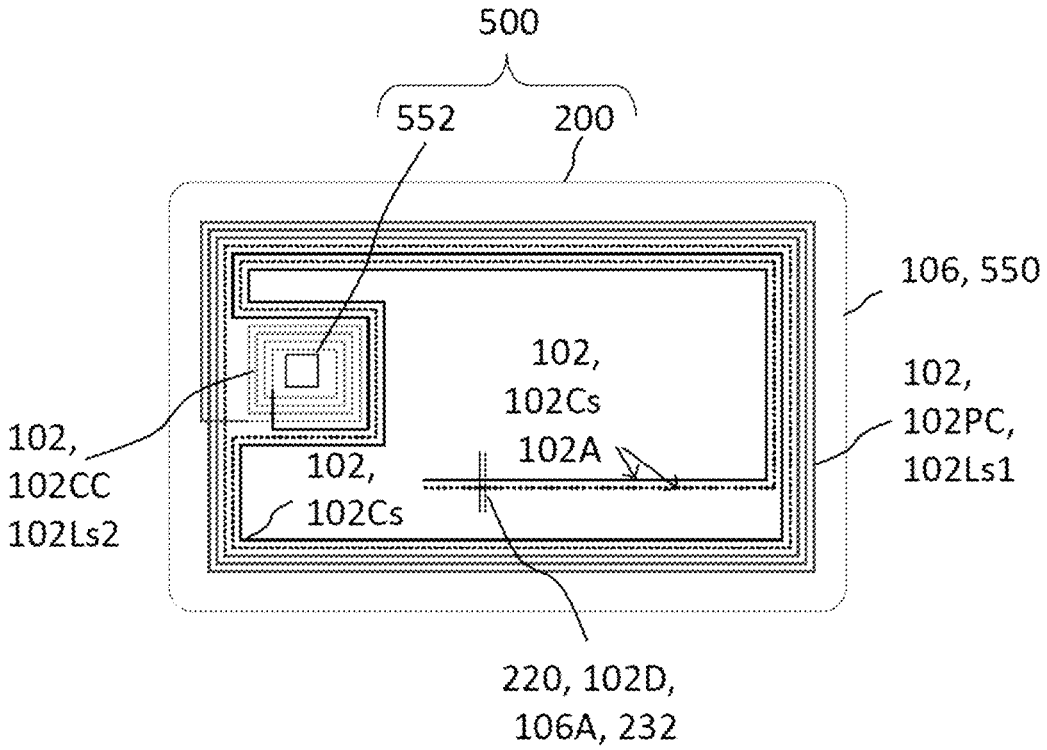
Figure 6A:
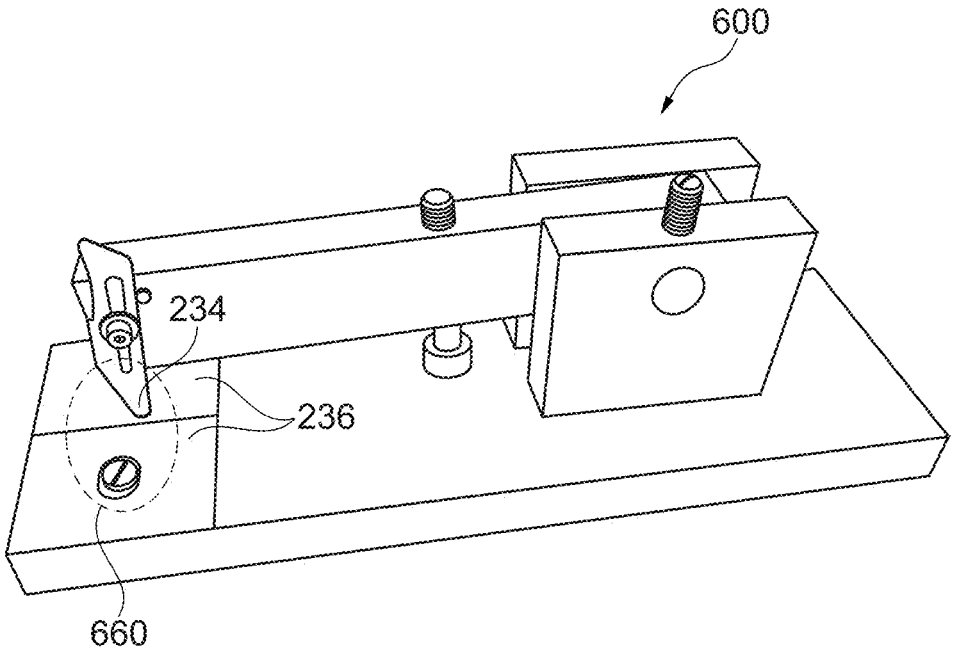
Figure 6B:
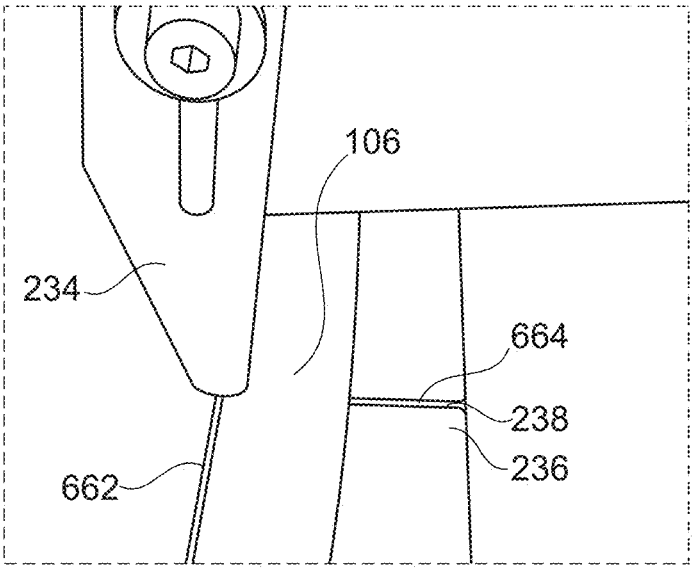
Figure 7:
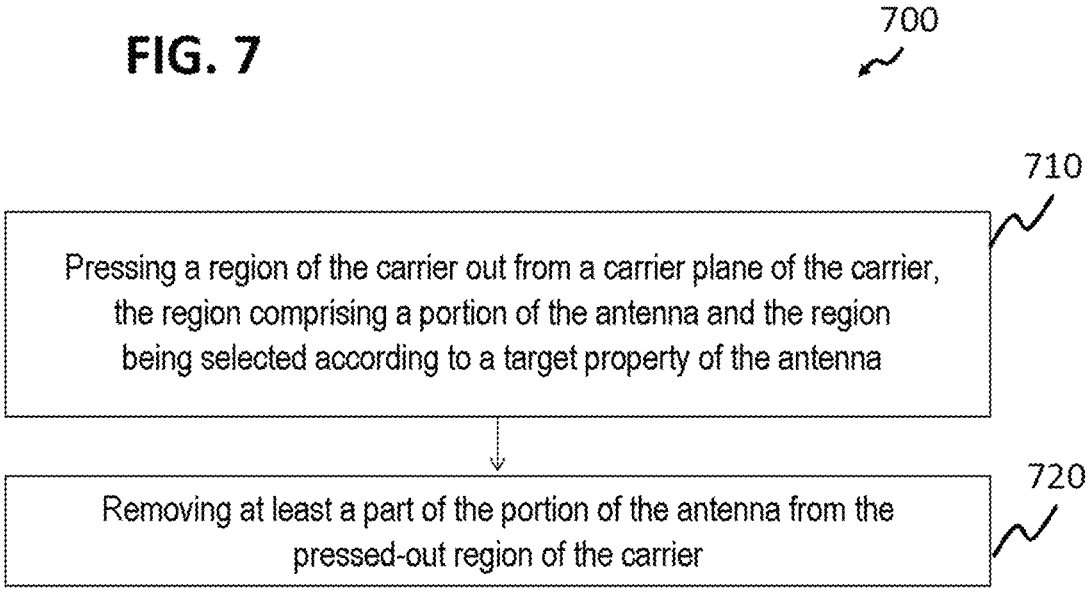
Figure 8:
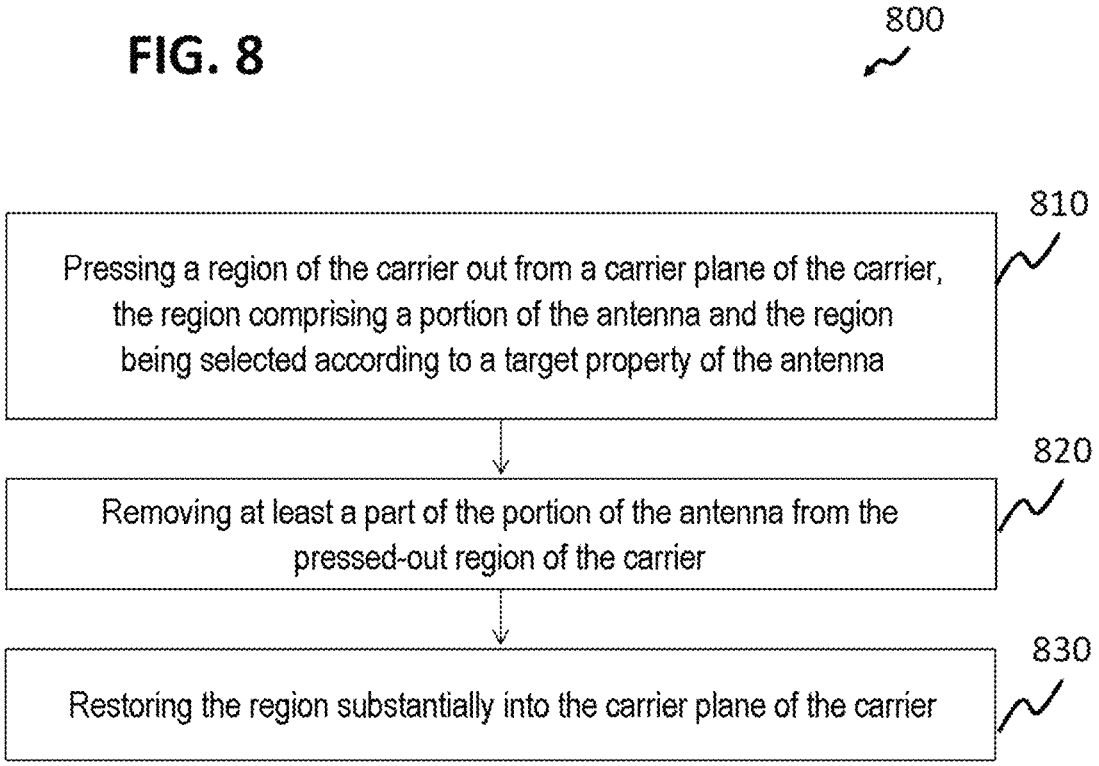

FIGS. 2B, 2C and 2D respectively show a schematic representation of a carrier according to various exemplary embodiments, in which a multiplicity of separating points in the capacitive region of the antenna are provided for trimming the antenna;

FIG. 3 shows a schematic representation of trimming of an antenna arranged on a carrier by means of a pressing-separating process according to various exemplary embodiments;

FIGS. 4A to 4D respectively show one or two detailed photographic views of a carrier according to various exemplary embodiments, in which a part of the carrier with a portion of the antenna has been subjected to the pressing-separating process, and the partially separated and deformed part of the carrier curves out from the plane of the carrier and the antenna portion originally located thereon has been removed, so that the antenna remains electrically interrupted;

FIG. 5 shows a schematic representation of a chip card according to various exemplary embodiment;

FIG. 6A shows a photographic view of a device for trimming an antenna applied on a carrier according to various exemplary embodiments;

FIG. 6B shows a detailed view of the device of FIG. 6A during the trimming of an antenna;

FIG. 7 shows a flowchart of a method for trimming an antenna applied on a carrier according to various exemplary embodiments; and FIG. 8 shows a flowchart of a method for producing a carrier structure according to various exemplary embodiments.

In the following detailed description, reference is made to the appended drawings, which form part of this description and in which specific embodiments, in which the disclosure may be carried out, are shown for illustration. In this regard, direction terminology such as "up", "down", "forward", "backward", "front", "rear", etc. is used with reference to the orientation of the figure or figures being described. Since component parts of exemplary embodiments may be positioned in a number of different orientations, the direction terminology is used for illustration and is in no way restrictive. It is to be understood that other exemplary embodiments may be used, and structural or logical variations may be carried out, without departing from the protective scope of the present disclosure. It is to be understood that the features of the various exemplary embodiments described herein may be combined with one another, unless otherwise specifically indicated. The following detailed description is therefore not to be interpreted in a restrictive sense, and the protective scope of the present disclosure is defined by the appended claims.

Parts, devices, instruments, etc., which are similar (for example with a similar or identical function) are provided herein with the same reference and sometimes differ from one another by a suffixed letter.

In the scope of this description, terms such as "connected", "attached" or "coupled" are used to describe both direct and indirect connection, direct or indirect attachment and direct or indirect coupling. In the figures, elements which are identical or similar are provided with identical references, insofar as this is expedient.

FIGS. 2B, 2C and 2D respectively show a schematic plan view of a carrier structure having a carrier, on which an antenna is applied (also referred to as an antenna structure) 200, according to various exemplary embodiments. FIG. 3 shows a schematic representation of trimming of an antenna 102 arranged on a carrier 106 by means of a pressing-separating process, according to various exemplary embodiments. FIGS. 4A to 4D respectively show one or two detailed photographic views of an antenna structure 200 according to various exemplary embodiments, having a carrier 106, in which a part of the carrier 106 with a portion of the antenna (already removed on the photographs and therefore no longer represented) has been subjected to a pressing-separating process, and the partially separated and pressed-out region 106A of the carrier 106 curves out from the plane of the carrier 106.

The antenna structure 200 may comprise a carrier 106 and an antenna 102, which is arranged on the carrier 106.

In various exemplary embodiments, the carrier may comprise polyvinyl chloride (PVC), polycarbonate (PC) or polyethylene terephthalate (PET), and/or another material conventionally used as a carrier for antenna structures.

Figure 1C:
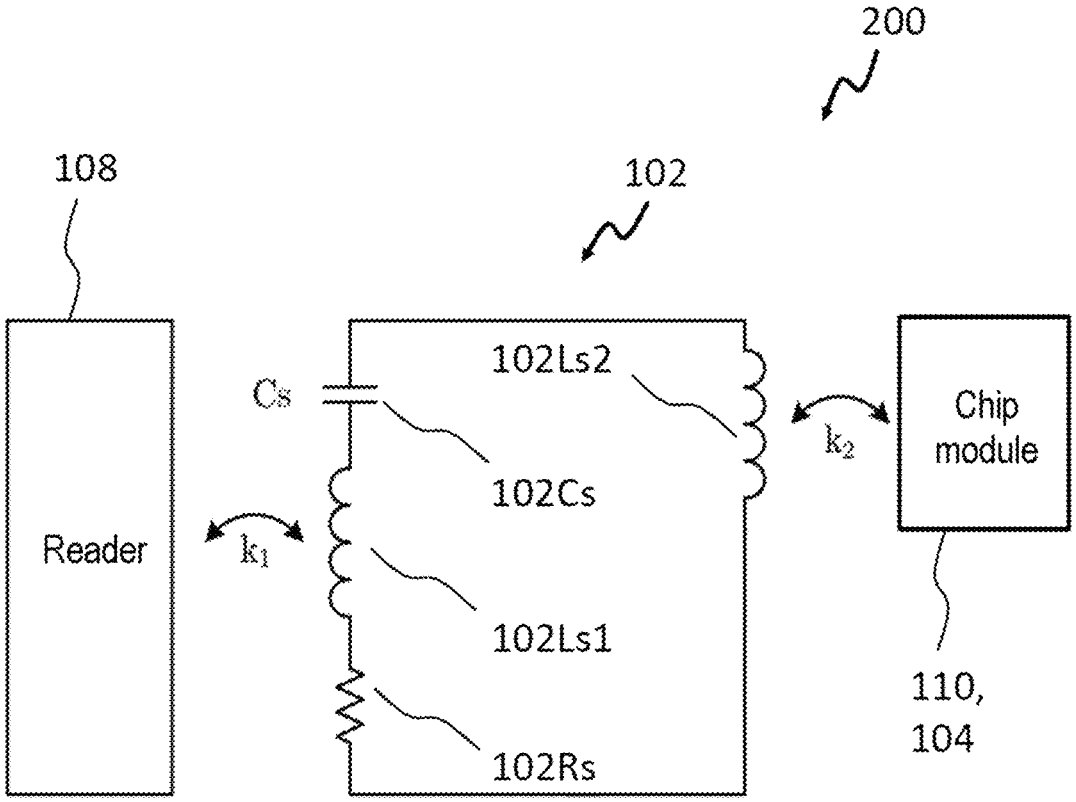
FIG. 1C shows a schematic view of a booster antenna which is contactlessly coupled to a reader and to a chip module (CoM)

The antenna 102 may, similarly as the antenna 102 of FIG. 1B and FIG. 1C, be formed as a series tuned circuit which comprises a pickup coil inductor 102Ls1 for coupling to an external reader, a coupling coil inductor 102Ls2 for coupling to a module antenna of a chip module (not represented), a resistor 102Rs (which is produced by the wire, for example a copper wire) and a series capacitor 102Cs.

In various exemplary embodiments, the antenna 102 may comprise a wire antenna, which may for example comprise a round wire. The antenna 102 may, as described above for the conventional antenna, be formed by means of an installation tool, for example by means of a sonotrode, on the (or partially embedded into) the carrier 106.

In various exemplary embodiments, the carrier 106 may comprise one or more regions (also referred to as positions) 220 which may be selected with a view to their suitability, by means of removing at least one portion 102D of the antenna 102 in this region, for achieving or at least approximately achieving a target property of the antenna 102 (for example a target resonant frequency).

In order to permit the removal of the at least one portion 102D of the antenna 102, a region 106A of the carrier 106 may be pressed out from a plane of the carrier 106, for example by means of a die 234. The pressing out may be carried out in such a way that the antenna 102 is located closer to the outer side of the region 106A of the carrier 106. In other words, that side of the carrier 106 on which the antenna 102 is at least partially exposed may face away from the die 234. The surface may be convexly curved on the outer side.

In this way, an antenna portion 102D which extends on or in the carrier region 106A (and which, for example, in the exemplary embodiments of FIG. 3, FIGS. 4A, 4C and 4D respectively comprises two parts), may be or become released from the carrier 106 in such a way that (insofar as it is detached from the rest of the antenna 102, see below) it can be removed easily from the carrier 106, for example by letting it fall out or by means of applying compressed air or reduced pressure, i.e. for example by means of blowing it out or sucking it away. In a case of an etched antenna 102, instead of this simple removal method it may be necessary for the portion 102D, which is released at most insubstantially from the carrier 106 by the pressing down, to be peeled off or removed in a comparable way.

In the carrier 106, besides the region 106A, at two separating positions 232, two separating points 232 may be or become formed, at which the carrier 106 and the antenna 102 are separate in order to carry out the trimming of the antenna 102 by interruption of the electrically conductive contact with at least a part of the capacitive region 102Cs of the antenna 102. Since, where the separating points 232 are formed, these coincide with the separating positions 232, the same references are used for both, even though in various exemplary embodiments (see, for example, FIG. 2B to FIG. 2D) more than two theoretically usable separating positions 232 may be provided.

In order to avoid one or more parts of the portion 102D of the antenna 102, which remain in the carrier 106 between the separating points 232, inadvertently again forming a conductive contact with the rest of the antenna 102, the portion 102D may be removed.

Since the portion 102D (or at least a part thereof) originally located on the carrier region 106A therefore is or becomes removed, the antenna 102 remains electrically interrupted, even in a case in which the carrier region 106A is pressed back into the carrier 106.

The separating points 232 may, for example, extend approximately perpendicularly to the longitudinal direction of the antenna 102 in this region. The separating points 232 may be arranged parallel or approximately parallel to one another. The separating points 232 may have a distance from one another in a range of from about 100 μm to about 2 mmm, for example from about 500 μm to about 1 mm. The separating points 232 may extend straight or have a curved shape, and may for example be formed in such a way that the carrier region 106A has a waisted shape.

A length of the carrier region 106A along the separating points 232 may, in various exemplary embodiments, be between about 1 mm and 3 mm, for example about 2 mm.

In various exemplary embodiments, a length of the carrier region 106A, a height by which the carrier region 106A is pressed out from the carrier plane, and a shape of the pressed-out carrier region 106A may be selected, for example matched to one another, in such a way that a tensile stress exerted on at least the outer side of the carrier region 106A stretches, or opens, the carrier material to such an extent that the part, located therein, of the antenna portion 102D can be removed easily, example (for instance in the case of a wire antenna) falls out by itself or may be sucked or blown out.

Figure 4A:
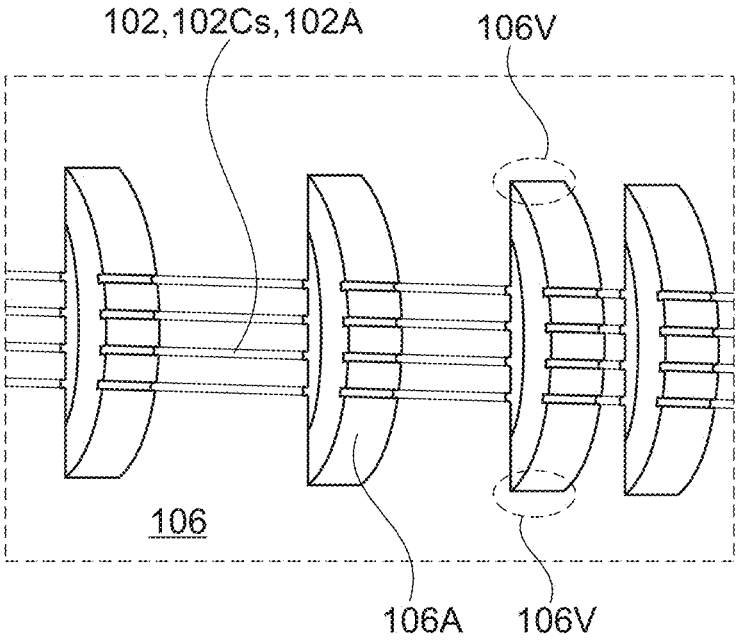
Figure 4B:
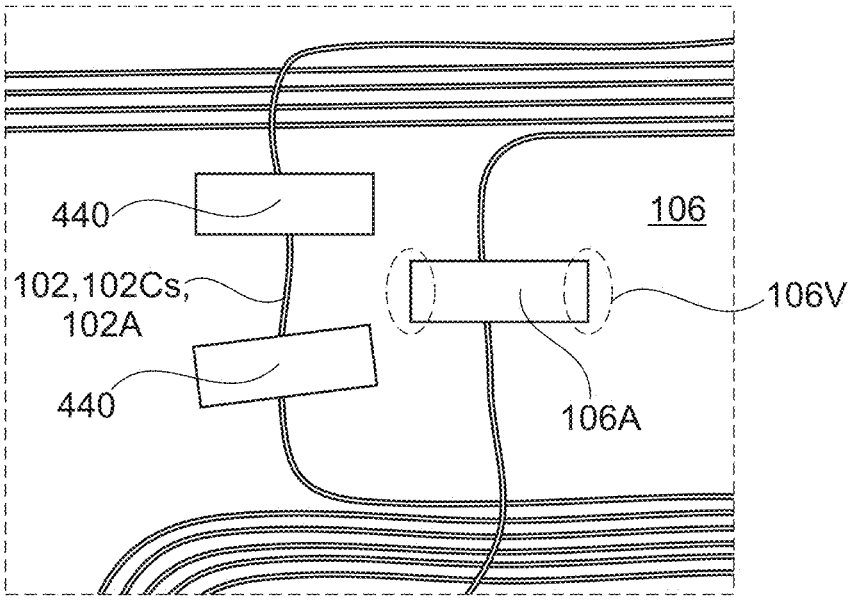
Figure 4C:
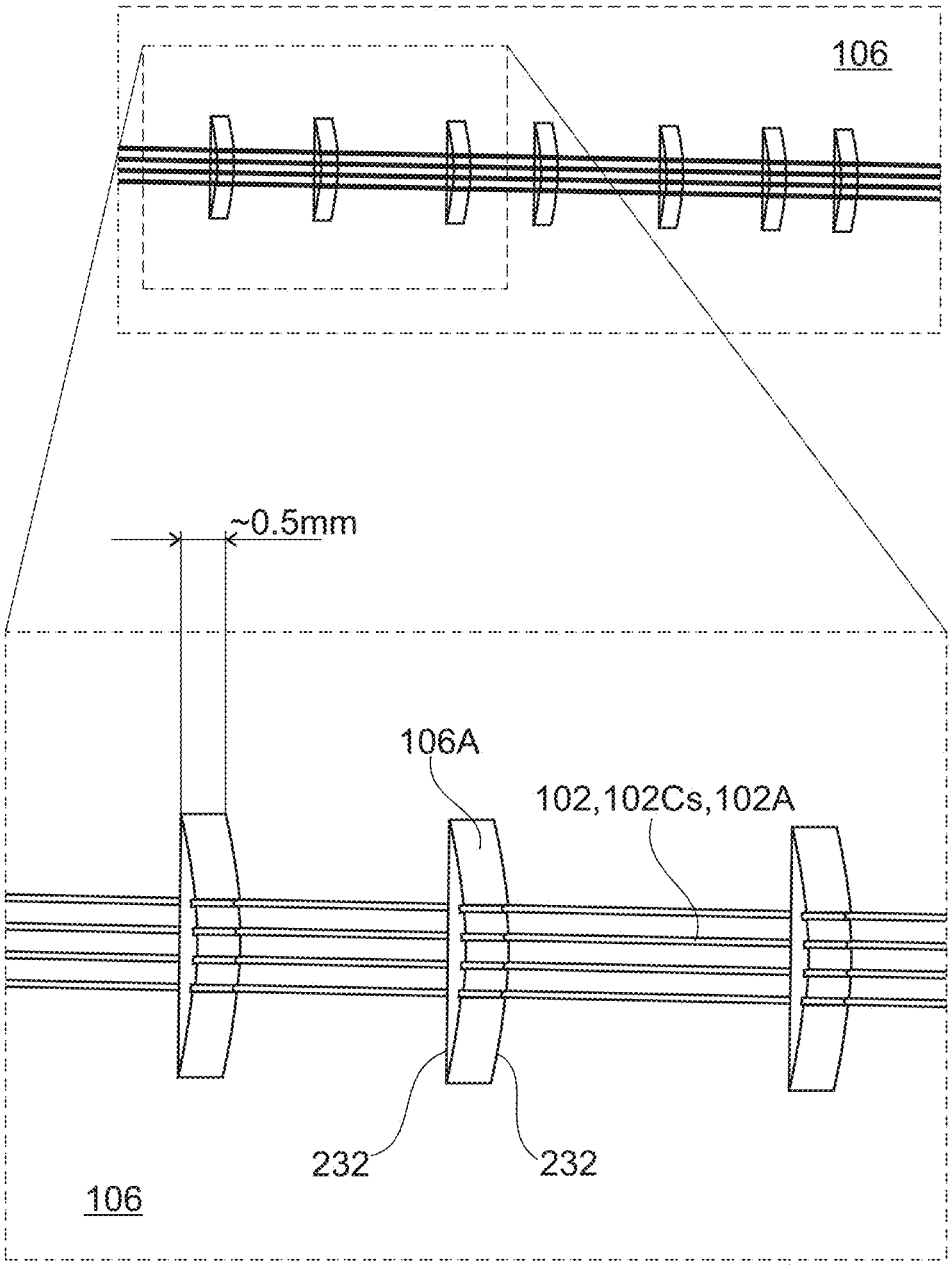
Figure 4D:
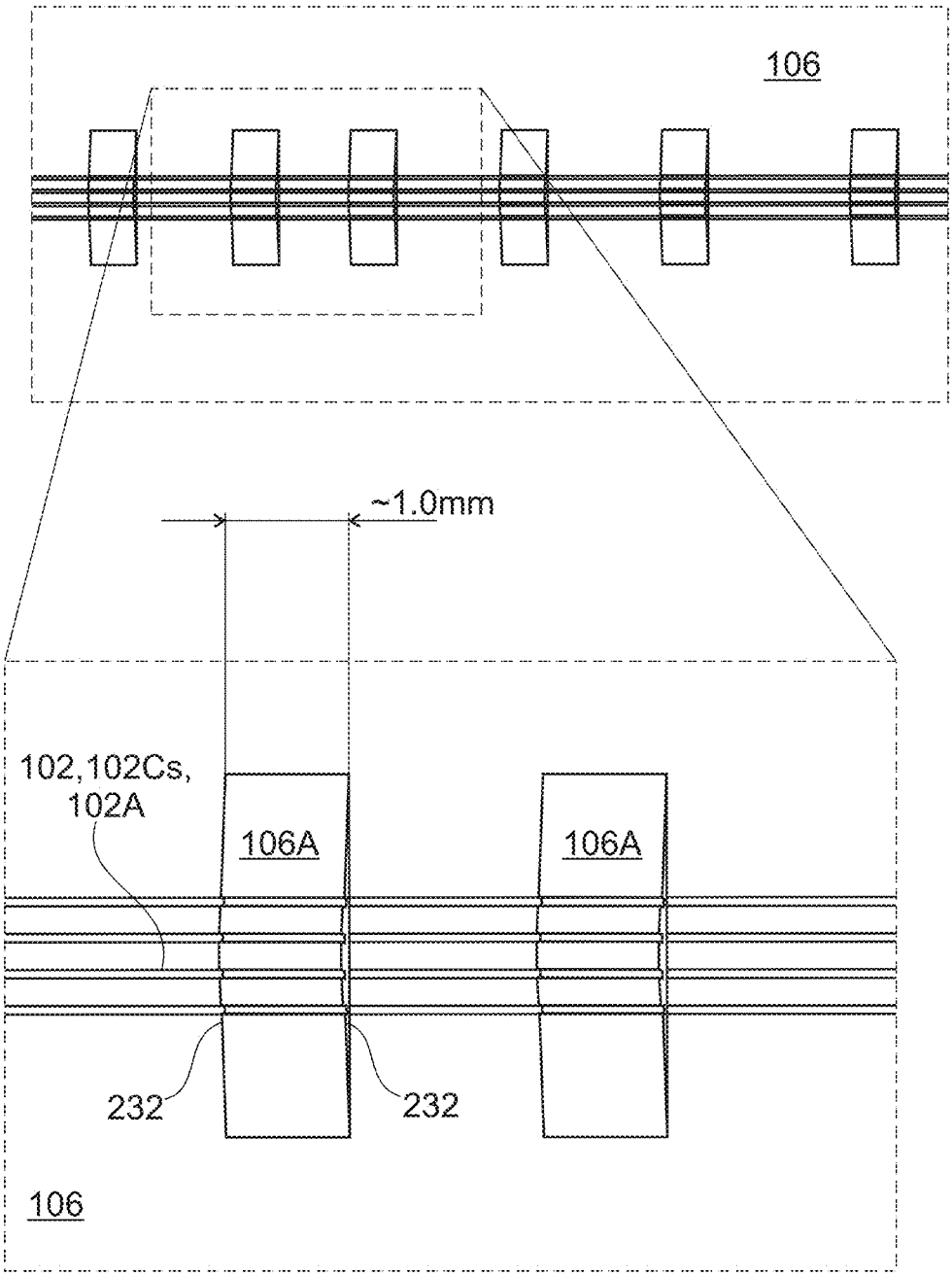

At a point at which the portion 102D is located before the removal, as shown for example in FIG. 4B, a groove 440 into which a part of the portion 102D is sunk may be open to such an extent that the part of the portion 102D can be removed easily.

The pressing out may, as is represented in FIG. 4B for the lower-left carrier region 106A, in various exemplary embodiments be continued to such an extent that the region 106A breaks between the antenna 102 and the die 234, i.e. below the groove 440. This may facilitate removal of the portion 102D of the antenna 102 without impairing the planarity of the carrier 106 after the lamination.

The two separating points 232 may be separate separating points 232. This means that the separating points 232 are not connected to one another. Rather, the carrier region 106A, which is located between the two separating points 232 may be connected to the rest of the carrier 106 between respective neighboring ends of the two separating points 232. These regions are also referred to as connecting regions 106V, and are denoted in FIGS. 4A and 4B by a dot-and-dash oval.

The separating points 232 in combination with the connecting regions 106V make it possible for the carrier region 106A to be deformed only between the separating points when a force is applied perpendicularly to the carrier plane.

By means of the pressing out and the removal of the portion 102D of the antenna 102, for example by means of a simultaneous pressing-separating process, a resonant frequency of the antenna 102 may be or become adjusted. In other words, by means of the formation of the separating points 232, through the carrier 106 and the antenna 102, the original resonant frequency which the antenna 102 has after its formation may be or become modified, for example increased, in such a way that a target resonant frequency is reached. If there is nevertheless still a deviation from the target reference frequency after the formation of the separating points 232, a statistical deviation may be reduced compared with the conventional production process as described above for the antenna structure.

The formation of the separating points 232 may, as represented by way of example in FIG. 3, be carried out by means of a shearing or cutting process, for example by means of a die 234, which presses the carrier region 106A into a recess 238 between two cutting plates 236 in such a way that during the process, in the carrier 106, the two separating points 232 are formed where the die 234 moves past the edges of the cutting plates 236.

As an alternative, the separating points 232 may be formed by means of cutting (for example by means of cutting blades), or by means of another known method which is suitable for producing the two separating points 232 and the carrier region 106A lying between them with comparable precision.

In order to press the carrier region 106A out, as likewise represented by way of example in FIG. 3, a force acting perpendicularly to the card plane may be exerted on the carrier region 106A. To this end, for example, it is possible to use the die 234 which, in combination with the cutting plates 236, may also be used for the formation of the separating points 232. This means that, in this exemplary embodiment, the formation of the separating points 232 and the deformation of the carrier region 106A between the separating points 232 take place simultaneously.

For the simultaneous pressing out of the carrier region 106A and separation of the antenna 102, as is represented by way of example with the aid of the photographs in FIG. 6A and FIG. 6B, it is possible to use a device 600 which comprises a die 234 and two cutting plates 236 spaced apart by the recess 238. Between cutting edges 664 arranged on the cutting plates 236, during the depression of the die 234 when introducing the carrier 106 with the antenna 102 into the recess 238, the carrier 106 is separated (for example sheared) along the two separating positions 232. In FIG. 6B, a side of the carrier 106 facing toward the die 234, rather than the antenna 102 a position marking 662 for the antenna 102 is depicted on the opposite side of the carrier from the antenna 102.

The exemplary device of FIG. 6A and FIG. 6B is a manually operated device 600. Of course, the device may nevertheless also be adapted for automated operation. For full automation, a refinement of the device 600 may, for example, be equipped with an automatic measuring instrument for checking the resonant frequency before and after trimming, an automatic cutting stamp (i.e. for example an electrically operated or electronically controlled cutting stamp similar to the device of FIG. 6A and FIG. 6B), automatic position detection with automatic control of the desired cutting position, and a device for automatic removal (blowing, suction) of the wire residues. For semiautomation of the trimming process, one or more of the devices or processes mentioned above may be replaced with manual processes or manually operated devices.

In the exemplary embodiment which provides formation of the separating points 232 without simultaneous pressing out of the carrier region 106A, the pressing out of the carrier region 106A may be carried out following the formation of the separating points 232, for example again by using a die 234, for example without the cutting plates 236 being used.

In various exemplary embodiments, before the formation of the separating points 232, it is possible to determine the extent to which the antenna 102 in its current configuration deviates from the target property, and for example the resonant frequency of the antenna 102 may be determined.

Many different methods may be used in order to measure the resonant frequency of the antenna structure 102, for example a network analyzer, other antennas, etc.

In various exemplary embodiments, an impulse response with the use of a Dirac pulse may be used as one of the most effective measurement methods.

The adjustment of the final resonant frequency of the antenna 102 may then be carried out while taking the measured resonant frequency into account. With knowledge of the resonant frequency of the current antenna 102 for example, it is possible to determine, for example with the aid of previously conducted laboratory tests and/or model calculations, the point at which the portion is to be removed in order to achieve a desired shift of the resonant frequency from the resonant frequency determined to the target resonant frequency. In various exemplary embodiments, markings which indicate positions for predetermined shifts of the resonant frequency may be arranged on the carrier.

The antenna 102 may comprise two ends and respective sections of the antenna which are adjacent to the ends may be installed next to one another in such a way that they form a capacitive region 102Cs. At least a part of the capacitive region 102Cs may be provided so that the pressing out of the region 106A of the carrier 106 and the subsequent removal of the portion 102D (and therefore the tuning of the antenna 102 to the resonant frequency) is carried out there. This part, also referred to as an adaptation part, adaptation region, tuning part or tuning region, of the antenna 102 is denoted by 102A in the figures.

The antenna 102 may furthermore comprise an inductive region, for example the above-described pickup coil inductor 102Ls1 for coupling to the external reader and the coupling coil inductor 102Ls2 for coupling to the module antenna of the chip module, in which case the interaction may be arranged in the capacitive region 102Cs of the antenna 102. The antenna structure 200 may therefore be used for a booster antenna, for example for use in a chip card as described above.

In this case, the capacitance of the antenna 102 may be reduced by the interaction in the antenna 102 so that the resonant frequency is increased by means of the interaction.

The combination of the pressing out of the carrier region 106A in combination with the removal of at least a part of the antenna, for example configured as the combined pressing-separating process, may be an economical production method for trimming an antenna 102 which comprises a Cu wire with a thickness of up to about 150 μm, for example up to about 120 μm, for example up to approximately 112 μm.

This means that a high quality and a good performability of the method with low costs may be achieved by means of the described method.

In various exemplary embodiments, as represented in FIG. 2C and FIG. 2D, the sections which are adjacent to the ends and form the capacitive region, for example the adaptation region 102A, may have a meandering structure. In this way, both a large and a fine frequency adaptation region can be made possible on a small surface region, because by means of a small change in the position of the tool for forming the separating regions 232, it is possible to achieve both fine tuning of the resonant frequency (insofar as the position change takes place along the meander structure) and a large change in the resonant frequency when modifying the position transversely to the meander structure.

In this case, the meander structure represented in FIG. 2C, which is formed around the intended separating positions for the separating points 232 in such a way that it comprises a longer piece without a direction change of the antenna profile than the meander structure in FIG. 2D, may be optimized with a view to a positioning tolerance of the tool (for example of the cutting, deforming and/or cutting-deforming tool). In other words, higher position tolerances may be tolerated along the antenna.

By means of the retrospective trimming of the antenna 102 after the placement (for example depositing or embedding) of the antenna 102 on or in the carrier 106 by the separation of the antenna 102, in various exemplary embodiments production tolerances of the (booster) antenna may be significantly relaxed. This means that economical, for example conventional, production lines may be used, and merely the retrospective tuning process may subsequently be carried out.

The carrier region 106A may, in various exemplary embodiments, be pressed back into the carrier 106 after the removal of the portion 102D, so that it is clinched and brought back into a plane with the rest of the carrier 106. The carrier 106 therefore has no shape or opening which is structurally weakening, and/or impairs a planarity of a chip card surface, at the separating position at which the separating points 232 were formed and the carrier region 106A was curved out from the carrier plane 106.

The pressing of the carrier region 106A back in may, in various exemplary embodiments, be carried out during a lamination process which is to be carried out anyway.

As an alternative, the pressing in may be carried out in a separate process, so that the carrier 106 having the trimmed antenna 102, in which the carrier region 106A again lies in the carrier plane, is subsequently obtained.

By means of heat or ultrasound, in various exemplary embodiments the carrier region 106A may be fixed to the rest of the carrier 106 during and/or after the pressing of the carrier region 106A into the carrier plane.

The carrier structures having an applied antenna structure 200 (FIG. 2B: 200*a*; FIG. 2C: 200*b*; FIG. 2D: 200*c*) are respectively represented before the trimming by means of forming the separating points 232, deforming the carrier region 106A and removing the portion 102D arranged on the carrier region 106A.

Each of the carrier structures having an applied antenna structure 200 provided comprises, on the antenna 102, a tuning region 102A which is intended for the formation of the separating points 232.

In the antenna structure 200*a* of FIG. 2B, the tuning region 102A is formed in an edge region of the carrier 106 and comprises only a capacitive section 102Cs, extending straight, as a tuning region 102A of the antenna 102.

In the antenna structure 200*b* of FIG. 2C and the antenna structure 200*c* of FIG. 2D, the tuning region 102A is respectively formed in a corner region of the carrier 106 as a meandering (capacitive) structure 102Cs respectively having twelve predetermined positions for carrying out the tuning. Even though the entire tuning region 102A may be used for the tuning of the antenna 102, the marked regions 220 provided may be particularly suitable for the arrangement of the separating points 232. This is because, for example, as seen in the longitudinal direction of the antenna 102, there may be a large distance there from the closest-lying antenna section laterally next to the antenna 102, compared with a length of the carrier region 106A, so that there is utmost the very small risk of unintentionally damaging other structures of the antenna 102 during arrangement of the separating points 232.

Furthermore, the meandering structures may be formed so regularly that the fine tuning of the antenna 102 may be carried out in a controlled way, for example when it is known priori by how much the resonant frequency of the antenna 102 is shifted during the tuning. For example, with each shortening of the antenna 102 in the exemplary embodiments of FIG. 2C and FIG. 2D, the resonant frequency $F_{res}$ may be changed by ~150 kHz (frequency becoming higher when shortening the antenna 102).

Furthermore, in the case of the antenna structure 200*b* of FIG. 2C, if the antenna 102 is respectively around the positions 220 which are intended for the arrangement of the separating points 232, the antenna 102 is shaped rectilinearly over a relatively long section (for example over a distance of between about 1 mm and about 1 cm, for example between about 3 mm and 8 mm, for example about 5 mm), which, as described above, increases a positioning tolerance (for example in comparison with the antenna structure 200*c*).

FIG. 5 shows a schematic plan view of a chip card 500 according to various exemplary embodiments.

The chip card 500 may comprise one of the above-described carrier structures 200 having a carrier 106 on which an antenna 102 is applied. The chip card 500 may furthermore comprise a chip module 552, which may be configured as described above as a CoM module and may be adapted to couple with the inductive coupling region 102Ls2.

FIG. 7 shows a flowchart of a method 700 for trimming an antenna applied on a carrier according to various exemplary embodiments.

The method 700 may comprise pressing a region of the carrier out from a carrier plane of the carrier, the region comprising a portion of the antenna and the region being selected according to a target property of the antenna (at 710), and removing at least a part of the portion of the antenna from the pressed-out region of the carrier (at 720).

FIG. 8 shows a flowchart of a method 800 for producing a carrier structure according to various exemplary embodiments.

The method 800 may comprise pressing a region of the carrier out from a carrier plane of the carrier, the region comprising a portion of the antenna and the region being selected according to a target property of the antenna (at 810), removing at least a part of the portion of the antenna from the pressed-out region of the carrier (at 820), and restoring the region substantially into the carrier plane of the carrier.

Some exemplary embodiments will be specified in brief below.

Exemplary embodiment 1 is a method for trimming an antenna applied on a carrier. The method comprises pressing a region of the carrier out from a carrier plane of the carrier, the region comprising a portion of the antenna and the region being selected according to a target property of the antenna, and removing at least a part of the portion of the antenna from the pressed-out region of the carrier.

Exemplary embodiment 2 is a method according to exemplary embodiment 1, wherein the method furthermore comprises forming the portion of the antenna by separating the antenna at two separating positions along the antenna profile.

Exemplary embodiment 3 is a method according to exemplary embodiment 2, wherein a cut is made in a region of the carrier during the separation of the antenna.

Exemplary embodiment 4 is a method according to exemplary embodiment 2 or 3, wherein one side of the portion is separated by means of at least one cutting edge.

Exemplary embodiment 5 is a method according to one of exemplary embodiments 1 to 4, wherein the region is pressed out from the carrier plane of the carrier beyond the elastic range of the carrier material.

Exemplary embodiment 6 is a method according to one of exemplary embodiments 1 to 5, wherein the antenna is embedded in the carrier, optionally with an entire cross section of the antenna.

Exemplary embodiment 7 is a method according to one of exemplary embodiments 1 to 6, wherein the antenna is exposed on at least one surface of the carrier.

Exemplary embodiment 8 is a method according to one of exemplary embodiments 1 to 7, wherein the antenna comprises an antenna wire.

Exemplary embodiment 9 is a method according to one of exemplary embodiments 1 to 8, wherein the carrier is a plastic carrier.

Exemplary embodiment 10 is a method according to one of exemplary embodiments 2 to 9, wherein the separation of the antenna is carried out before or during the pressing of the region out from the carrier plane of the carrier.

Exemplary embodiment 11 is a method according to one of exemplary embodiments 1 to 10, wherein the antenna is formed as a booster antenna in the form of a loop antenna, the booster antenna defining a chip coupling region.

Exemplary embodiment 12 is a method according to one of exemplary embodiments 1 to 11, wherein the antenna is arranged on an outer side of the pressed-out region of the carrier.

Exemplary embodiment 13 is a method for producing a carrier structure having a carrier on which an antenna is applied. The method comprises carrying out a method for trimming the antenna according to one of exemplary embodiments 1 to 12, and restoring the region substantially into the carrier plane of the carrier.

Exemplary embodiment 14 is a method according to exemplary embodiment 13, wherein the restoration of the region is carried out in the scope of a laminating process.

Exemplary embodiment 15 is a method according to exemplary embodiment 13 or 14, wherein the carrier structure forms a chip card body.

Exemplary embodiment 16 is a device for trimming an antenna applied on a carrier. The device comprises a reception region for receiving the carrier, the reception region comprising a recess, and a die adapted to press a region of the carrier out from a carrier plane of the carrier into the recess, the region comprising a detached portion of the antenna and the region being selected according to a target property of the antenna.

Exemplary embodiment 17 is a device according to exemplary embodiment 16, furthermore comprising at least one cutting edge for separating the antenna.

Exemplary embodiment 18 is a device according to exemplary embodiment 16 or 17, wherein the at least one cutting edge comprises two parallel cutting edges for separating the antenna on two sides.

Exemplary embodiment 19 is a carrier structure. The carrier structure comprises a carrier, on which an antenna is applied, wherein a region of the carrier between two antenna regions of the antenna which are electrically insulated from one another is pressed out from a carrier plane of the carrier, the region being selected according to a target property of the antenna.

Exemplary embodiment 20 is a carrier structure according to exemplary embodiment 19, wherein the antenna is embedded in the carrier, optionally with an entire cross section of the antenna.

Exemplary embodiment 21 is a carrier structure according to one of exemplary embodiments 19 and 20, wherein the antenna is exposed on at least one surface of the carrier.

Exemplary embodiment 22 is a carrier structure according to one of exemplary embodiments 19 to 21, wherein the antenna comprises an antenna wire.

Exemplary embodiment 23 is a carrier structure according to one of exemplary embodiments 19 to 22, wherein the carrier is a plastic carrier.

Exemplary embodiment 24 is a carrier structure according to one of exemplary embodiments 19 to 23, wherein the antenna is formed as a booster antenna in the form of a loop antenna, the booster antenna defining a chip coupling region.

Exemplary embodiment 25 is a chip card having a carrier structure according to one of exemplary embodiments 19 to 24.

Further advantageous configurations of the method may be found from the description of the device, and vice versa.

The invention claimed is:

1. A method for trimming an antenna applied on a carrier, the method comprising:

pressing a region of the carrier out from a carrier plane of the carrier, the region comprising a portion of the antenna, the region being selected according to a target property of the antenna, wherein the act of pressing the region of the carrier from the carrier plane separates at least a part of the portion of the antenna from the carrier without removing the region from the carrier to thereby facilitate a selective restoration of the region hack into the carrier plane of the carrier via a subsequent restoration process; and removing the at least the part of the portion of the antenna from the pressed-out region of the carrier to cause an electrical interruption in the antenna corresponding to the location of the antenna at which the at least the part of the portion of the antenna is removed, wherein the target property is a resonant frequency of the antenna, and wherein the at least the part of the portion of the antenna that is removed comprises a tuning portion of the antenna that results in a tuning of the resonant frequency.

2. The method as claimed in claim 1, further comprising:

forming the portion of the antenna by separating the antenna at two separating positions along a profile of the antenna.

3. The method as claimed in claim 2, wherein a cut is made in the region of the carrier during the separation of the antenna.

4. The method as claimed in claim 2, wherein one side of the portion of the antenna is separated by means of at least one cutting edge.

5. The method as claimed in claim 2, wherein the separation of the antenna is performed prior to or during the act of pressing of the region out from the carrier plane of the carrier.

6. The method as claimed in one of claim 1, wherein the region is pressed out from the carrier plane of the carrier beyond an elastic range of the carrier material.

7. The method as claimed in claim 1, wherein an entire cross section of the antenna is embedded in the carrier.

8. The method as claimed in claim 1, wherein the antenna is exposed on at least one surface of the carrier.

9. The method as claimed in claim 1, wherein the antenna comprises an antenna wire.

10. The method as claimed in claim 1, wherein the carrier is a plastic carrier.

11. The method as claimed in claim 1, wherein the antenna is formed as a booster antenna in the form of a loop antenna, the booster antenna defining a chip region.

12. The method as claimed in claim 1, wherein the antenna is arranged on an outer side of a pressed-out region of the carrier.

13. The method as claimed in claim 1, further comprising:

restoring, via the subsequent restoration process, the region of the carrier substantially into the carrier plane of the carrier to produce a carrier structure having the carrier on which the antenna is applied.

14. The method as claimed in claim 13, wherein the restoration of the region of the carrier structure is performed via a laminating process.

15. The method as claimed in claim 13, wherein the carrier forms a chip card body.

16. The method as claimed in claim 1, wherein the tuning of the resonant frequency as a result of removing the tuning portion of the antenna comprises reducing a deviation of the resonant frequency from a predetermined resonant frequency.

17. A device for trimming an antenna applied on a carrier, the device comprising:

a recess configured to receive the carrier; and a die adapted to press a region of the carrier out from a carrier plane of the carrier into the recess to separate at least a part of a portion of the antenna from the carrier without removing the region from the carrier to thereby facilitate a selective restoration of the region back into the carrier plane of the carrier via a subsequent restoration process, the region comprising a detached portion of the antenna, and the region being selected according to a target property of the antenna, wherein at least the part of the portion of the antenna is removed from the pressed-out region of the carrier to cause an electrical interruption in the antenna corresponding to the location of the antenna at which the at least the part of the portion of the antenna is removed, wherein the target property is a resonant frequency of the antenna, and wherein the at least the part of the portion of the antenna that is removed comprises a tuning portion of the antenna that results in a tuning of the resonant frequency.

18. The device as claimed in claim 17, further comprising:

at least one cutting edge for separating the antenna.

19. The device as claimed in claim 18, wherein the at least one cutting edge comprises two parallel cutting edges for separating the antenna on two sides.

20. A carrier structure, comprising:

an antenna; and a carrier, on which the antenna is applied, wherein a region of the carrier between two regions of the antenna, which are electrically insulated from one another, is pressed out from a carrier plane of the carrier to separate at least a part of a portion of the antenna from the carrier without removing the region from the carrier to thereby facilitate a selective restoration of the region back into the carrier plane of the carrier via a subsequent restoration process, the region being selected according to a target property of the antenna, and wherein at least the part of the portion of the antenna is removed from the pressed-out region of the carrier to cause an electrical interruption in the antenna corresponding to the location of the antenna at which the at least the part of the portion of the antenna is removed, wherein the target property is a resonant frequency of the antenna, and wherein the at least the part of the portion of the antenna that is removed comprises a tuning portion of the antenna that results in a tuning of the resonant frequency.

21. The carrier structure as claimed in claim 20, wherein the antenna comprises an antenna wire.

22. A chip card having the carrier structure as claimed in claim 20.

23. The carrier structure of claim 20, wherein:

the antenna comprises a loop antenna having a first loop portion and a second loop portion, the first loop portion comprises a coupling coil inductor configured to couple to an antenna of an external chip, and the second loop portion comprises a meandering structure comprising a plurality of portions, each one of the plurality of portions comprising a respective series capacitance and being associated with a respective portion of the loop antenna that is removable from the carrier to cause an electrical interruption in the loop antenna.

* * * * *